US010019947B2

(12) United States Patent
Zhou

(10) Patent No.: US 10,019,947 B2
(45) Date of Patent: Jul. 10, 2018

(54) DISPLAY DEVICE, PIXEL DRIVING CIRCUIT AND DRIVING METHOD THEREOF

(71) Applicant: EverDisplay Optronics (Shanghai) Limited, Shanghai (CN)

(72) Inventor: Xingyu Zhou, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 23 days.

(21) Appl. No.: 15/384,428

(22) Filed: Dec. 20, 2016

(65) Prior Publication Data

US 2017/0358261 A1 Dec. 14, 2017

(30) Foreign Application Priority Data

Jun. 13, 2016 (CN) ..... 2016 1 0410617

(51) Int. Cl.
*G09G 3/3258* (2016.01)
*G09G 3/3266* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2300/0842* (2013.01); *G09G 2300/0871* (2013.01); *G09G 2310/0216* (2013.01)

(58) Field of Classification Search
CPC ... G09G 3/3258; G09G 3/3266; G09G 3/3275
See application file for complete search history.

(56) References Cited

U.S. PATENT DOCUMENTS

| | | | | |
|---|---|---|---|---|
| 9,793,005 | B2 * | 10/2017 | Xiao | G11C 19/184 |
| 9,805,650 | B2 * | 10/2017 | Gu | G09G 3/3233 |
| 2012/0050234 | A1 * | 3/2012 | Jang | G09G 3/3225 345/204 |
| 2015/0015554 | A1 * | 1/2015 | Kim | G09G 3/3208 345/208 |
| 2015/0302934 | A1 * | 10/2015 | Qi | G11C 19/184 377/54 |
| 2016/0147368 | A1 * | 5/2016 | Kim | G06F 3/044 345/174 |
| 2016/0266688 | A1 * | 9/2016 | Yang | G06F 3/041 |
| 2016/0266689 | A1 * | 9/2016 | Yang | G06F 3/0412 |
| 2016/0275854 | A1 * | 9/2016 | Wang | G09G 3/3233 |
| 2017/0102589 | A1 * | 4/2017 | Yang | G02F 1/133621 |
| 2017/0270860 | A1 * | 9/2017 | Wang | G09G 3/3258 |
| 2017/0287941 | A1 * | 10/2017 | Toya | H01L 27/124 |

* cited by examiner

*Primary Examiner* — Ricardo L Osorio
(74) *Attorney, Agent, or Firm* — Yunling Ren

(57) ABSTRACT

The present disclosure relates to a display device, a pixel driving circuit and a driving method thereof. The OLED pixel driving circuit includes an electroluminescent devices, first to seventh switching elements and a storage capacitor. The sixth switching element has a first terminal coupled to a first node and a second terminal coupled to a third node, the seventh switching element has a first terminal receiving an initialization voltage, and a second terminal coupled to the first node.

13 Claims, 12 Drawing Sheets

DISPLAY DEVICE, PIXEL DRIVING CIRCUIT AND DRIVING METHOD THEREOF

CROSS-REFERENCE TO RELATED APPLICATIONS

This application claims priority to Chinese Patent Application No. 201610410617.X, filed on Jun. 13, 2016, the entire contents of which are incorporated herein by reference.

TECHNICAL FIELD

The present disclosure generally relates to display technologies, and more particularly to a pixel driving circuit, a driving method of the pixel driving circuit, and a display device including the pixel driving circuit.

BACKGROUND

Organic Light Emitting Diodes (OLEDs) display panels have advantages such as faster response speed, higher color purity, brightness and contrast ratio and wider viewing angle as compared with conventional liquid crystal display panels, and thus have attracted more and more attentions from display technology developers.

FIG. 1 is a schematic diagram showing a partial structure of a conventional OLED display device. A plurality of sub-pixels P arranged in an array form a display region AA, a gate driver provide scan signals to each row of sub-pixels P in the display region AA by scan lines SL, and a source driver provides data signals to each column of sub-pixels P in the display region AA by data lines DL.

In order to save costs, the source driver in FIG. 1 includes a plurality of signal output portions MUX (for example, a plurality of multiplexers), each of which provides data signals to a plurality of data lines. A switch is provided on each data line. For example, each signal output portion MUX in FIG. 1 provides data signals to six data lines, and the data lines are provided with switches, respectively, which are driven by driving signals SW1 to SW6. FIG. 2 is a diagram showing timing of the driving signals SW1 to SW6 in FIG. 1. After one row of sub-pixels are turned on (time period of $t_1$), the driving signals SW1 to SW6 can control the switches to enable one signal output portion MUX to provide display data for six data lines in a time-sharing manner.

The writing of data signals in the conventional technologies is unidirectional, that is, the writing of data signals can only be performed from low level to high level. After the switches are turned off, the data lines may maintain a part of the written data. If a high-level data signal (for example, 6V, black state), is written into a data line in a previous frame, after the switch corresponding to the data line is turned off, the high-level data signal can be partially maintain on the data line. Then, if a low-level data signal (for example, 3V, white state) is to be written into the data line in the current frame, after the switch is turned on, the data signal to be written in the current frame may not be written into the data line successfully. As a result, display abnormality may occur during the brightness switching from black to white.

To address the above problem, one technical solution in prior arts is as shown in FIG. 2. Specifically, for every frame, before the data signal is written (the time period of $t_2$), the switches on all the data lines are turned on by the driving signals SW1 to SW6, and each of the signal output portions MUXs provides data signals of the lowest voltage to remove the residual data signal on each data line in the previous frame. This can avoid the problem that low-level data signals cannot be written. However, this technical solution results in increased complexity in timing of the driving signals and power consumption of the source driver.

SUMMARY

One of the objectives of the present disclosure is to provide a pixel driving circuit, a driving method of the pixel driving circuit and a display device including the pixel driving circuit, which are capable of at least overcoming a part of the problems resulted from the limitations and deficiencies in related arts.

Other features and advantages of the present disclosure will become clearer from the following detailed descriptions, or partially appreciated by the practice of the present disclosure.

According to a first aspect of the present disclosure, there is provided a pixel driving circuit for driving an organic light emitting diode to emit light. The pixel driving circuit includes:

a first switching element configured to receive a data signal from a data line in response to a first scan signal, and coupled to a first node;

a second switching element coupled to the first node and a second node;

a third switching element configured to respond to the first scan signal and coupled to the second node and a third node;

a fourth switching element configured to receive a driving voltage in response to a light emitting signal, and coupled to the first node;

a fifth switching element configured to respond to the light emitting signal and coupled to the second node and the organic light emitting diode;

a sixth switching element configured to respond to a reset signal and coupled to the first node and the third node;

a seven switching element configured to receive an initializing voltage in response to the reset signal, and coupled to the first node; and a storage capacitor coupled to the third node.

According to an exemplary embodiment of the present disclosure, an enabling stage of the first scan signal partially overlaps with an enabling stage of the reset signal.

According to an exemplary embodiment of the present disclosure, the reset signal is a second scan signal, the first scan signal is provided by an N-th scan line, and the second scan signal is provided by an (N−1)-th scan line.

According to an exemplary embodiment of the present disclosure, the pixel driving circuit further includes:

an eight switching element configured to receive the initialization voltage in response to the reset signal, and coupled to the fifth switching element.

According to an exemplary embodiment of the present disclosure, each of the switching elements includes a transistor.

According to an exemplary embodiment of the present disclosure, the third switching element includes two transistors connected in parallel.

According to an exemplary embodiment of the present disclosure, all of the transistors are P type thin film transistors, the driving voltage is a high-level driving voltage, the fifth switching element is connected to an anode of the organic light emitting diode, and a cathode of the organic light emitting diode is connected to a low-level voltage.

According to an exemplary embodiment of the present disclosure, all of the transistors are N type thin film transistors, the driving voltage is a low-level driving voltage, the fifth switching element is connected to a cathode of the organic light emitting diode, and an anode of the organic light emitting diode is connected to a high-level voltage.

According to a second aspect of the present disclosure, there is provided a driving method of a pixel driving circuit which is configured to drive an organic light emitting diode to emit light.

in a first reset stage, turning on sixth and seventh switching elements in the pixel driving circuit by a reset signal, and resetting a storage capacitor in the pixel driving circuit by an initialization voltage through the sixth and seventh switching elements;

in a second reset stage, turning on a first switching element in the pixel driving circuit by a first scan signal and turning on the seventh switching element by the reset signal, and resetting a data line by the initialization voltage through the first and seventh switching elements;

in a charging stage, turning on the first switching element and a third switching element in the pixel driving circuit by the first scan signal to enable a second switching element in the pixel driving circuit to form a diode connection, and writing a data signal into the storage capacitor by the first, second and third switching elements;

in a display stage, turning on fourth and fifth switching elements in the pixel driving circuit using a light emitting signal and turning on the second switching element using the voltage stored in the storage capacitor, and driving the organic light emitting diode to emit light by the driving voltage through the fourth, second and fifth switching elements.

According to an exemplary embodiment of the present disclosure, the method further includes:

in the first reset stage, turning on an eighth switching element in the pixel driving circuit by the reset signal, and resetting the organic light emitting diode by the initialization voltage through the eighth switching element.

According to a third aspect of the present disclosure, there is provided a display device, including:

a plurality rows of scan lines configured to output scan signals including second scan signals and first scan signals which are provided alternately;

a plurality columns of data lines configured to output data signals; and a plurality of pixel driving circuits electrically connected to the scan lines and the data lines, wherein each of the pixel driving circuits is any one of the pixel driving circuits as described above.

According to an exemplary embodiment, the display device further includes:

a gate driver configured to provide scan signals to the scan lines; and a source driver comprising M signal output portions wherein each of the signal output portions outputs the data signals to N columns of data lines, and each of the data lines is provided with a switch, and M×N equals to the number of the data lines.

According to an exemplary embodiment of the present disclosure, N equals to 6.

In the pixel driving circuit provided by exemplary embodiments of the present disclosure, the first terminal of the sixth switching element is coupled to the first node, the second terminal of the sixth switching element is coupled to the third node, the first terminal of the seventh switching element receives the initialization voltage, and the second terminal of the seventh switching element is coupled to the first node. On the one hand, the storage capacitor can be reset by the initialization voltage through the sixth and seventh switching elements to eliminate the influence of the residual voltage signal in the previous frame. On the other hand, when the enabling stage of the first scan signal partially overlaps with the enabling stage of the reset signal, the data line can be reset using the initialization voltage after the first to seventh switching elements all become turned on, and thus the residual data signal on the data line in the previous frame can be removed, and the problem that low-level data signals cannot be written is solved.

BRIEF DESCRIPTION OF THE DRAWINGS

The above and other features and advantages of the present disclosure will become clearer from the description of exemplary embodiments with reference to drawings.

REFERENCE SIGNS

Figure 1:
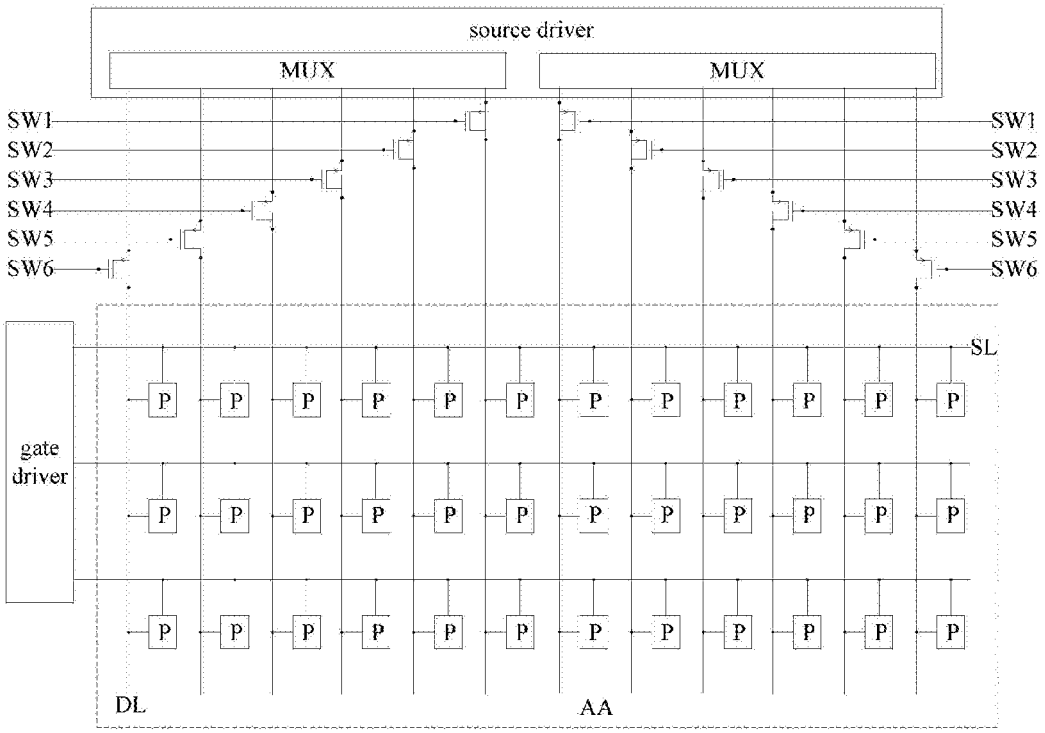
Fig. 1 (Prior Art)
FIG. 1 is a schematic diagram showing a part of the structure of a conventional display device.
Figure 2:
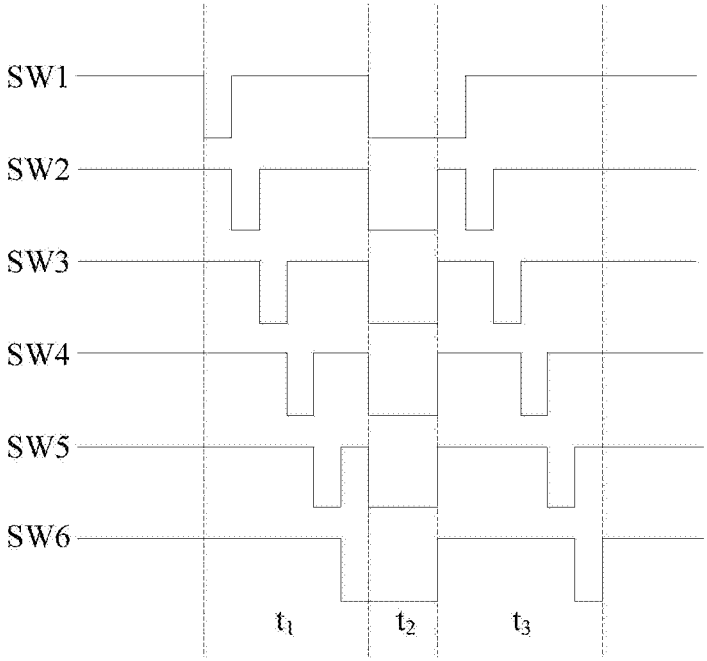
Fig. 2 (Prior Art)
FIG. 2 is a diagram showing timing of driving signals SW1 to SW6 in FIG. 1.

AA display region
P sub-pixels
DL data lines
SL scan lines
MUX signal output portions
SW1 to SW6 driving signals
M1 to M8 first to eighth switching element
N1 to N3 first to third nodes
OLED organic light emitting diode
Cst Storage capacitor
DATA Data signal
Sn first scan signal
Sn−1 reset signal/second scan signal
En light emitting signal
Vdd driving signal
Vss Low-level voltage
Vin initialization voltage

DETAILED DESCRIPTION

Now, exemplary implementations will be described more comprehensively with reference to the accompanying drawings. However, the exemplary implementations may be carried out in various manners, and should not be interpreted as being limited to the implementations set forth herein; instead, providing these implementations will make the present disclosure more comprehensive and complete and will fully convey the conception of the exemplary implementations to the ordinary skills in this art. Throughout the drawings, the like reference numbers refer to the same or the like structures, and repeated descriptions will be omitted.

The features, structures or characteristics described herein may be combined in one or more embodiments in any suitable manner. In the following descriptions, many specific details are provided to facilitate sufficient understanding of the embodiments of the present disclosure. However, one of ordinary skills in this art will appreciate that the technical solutions in the present disclosure may be practiced without one or more of the specific details, or by employing other methods, components, materials and so on. In other conditions, well-known structures, materials or operations are not shown or described in detail so as to avoid confusion of respective aspects of the present disclosure.

An exemplary embodiment of the present disclosure provides a pixel driving circuit. The pixel driving circuit can be used to drive an OLED to emit light. The pixel driving circuit can include a first switching element, a second switching element, a third switching element, a fourth switching element, a fifth switching element, a sixth switching element, a seventh switching element, and a storage capacitor. The first switching element is configured to receive a data signal from a data line in response to a first scan signal, and coupled to a first node. The second switching element is coupled to the first node and a second node. The third switching element is configured to respond to the first scan signal and coupled to the second node and a third node. The fourth switching element is configured to receive a driving voltage in response to a light emitting signal, and coupled to the first node. The fifth switching element is configured to respond to the light emitting signal and coupled to the second node and the organic light emitting diode. The sixth switching element is configured to respond to a reset signal and coupled to the first node and the third node. The seventh switching element is configured to receive an initializing voltage in response to the reset signal, and coupled to the first node The storage capacitor is coupled to the third node. In the following examples described in connection with FIG. 3, for example, each of the first to seventh switching elements includes a first terminal, a second terminal a control terminal.

Figure 3:
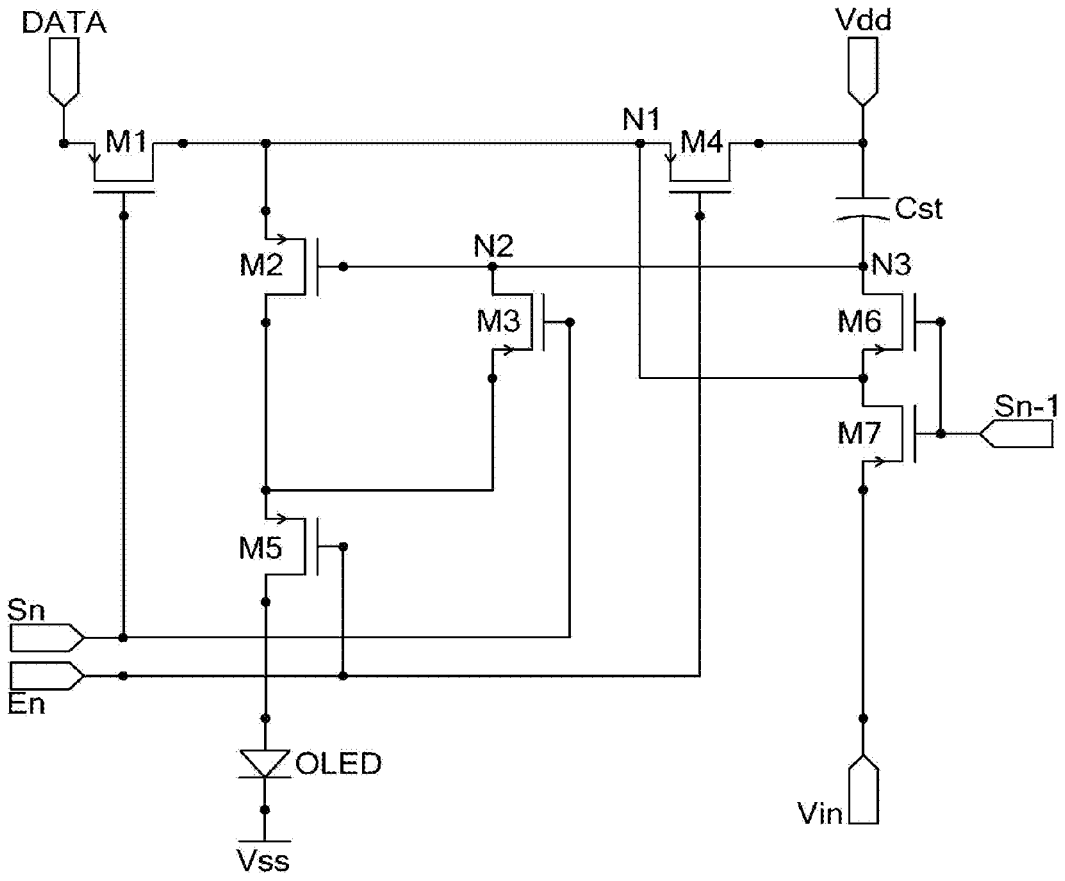
FIG. 3 is a schematic diagram showing a pixel driving circuit according to an exemplary embodiment.

As shown in FIG. 3, the pixel driving circuit is used to drive an OLED to emit light. The pixel driving circuit mainly includes a first switching element M1, a second switching element M2, a third switching element M3, a fourth switching element M4, a fifth switching element M5, a sixth switching element M6, a seventh switching element M7, and a storage capacitor Cst and so on.

A first terminal of the first switching element M1 is coupled to a data line which provides a data signal DATA, a second terminal of the first switching element M1 is coupled to a first node N1, and a control terminal of the first switching element M1 receives a first scan signal Sn. Under the control of the first scan signal Sn, the data signal DATA can be written into the first node N1 using the first switching element M1. A first terminal of the second switching element M2 is coupled to the first node N1, a second terminal of the second switching element M2 is coupled to a second node N2, and a control terminal of the second switching element M2 is coupled to a third node N3. The second switching element M2 can be turned on or off depending on the voltage at the third node N3. A first terminal of the third switching element M3 is coupled to the second node B2, a second terminal of the third switching element M3 is coupled to the third node N3, and a control terminal of the third switching element M3 receives the first scan signal Sn. The storage capacitor Cst is coupled between a driving voltage Vdd and the third node N3. Under the control of the first scan signal Sn, the data signal DATA can be written into the third node N3 using the first switching element M1, the second switching element M2 and the third switching element M3, and thereby the data signal DATA can be stored in the storage capacitor Cst. A first terminal of the fourth switching element M4 is coupled to the first node N1, a second terminal of the fourth switching element M4 receives the driving voltage Vdd, and a control terminal of the fourth switching element M4 receives a light emitting signal En. A first terminal of the fifth switching element M5 is coupled to the second node N2, a second terminal of the fifth switching element M5 is coupled to the OLED, and a control terminal of the fifth switching element M5 receives the light emitting signal En. In response to the light emitting signal En, the fourth switching element M4 and the fifth switching element M5 can apply the driving voltage Vdd onto the OLED through the second switching element M2, and then the OLED can emit light. In the exemplary embodiment, the driving voltage Vdd is a high-level driving voltage, for example.

A first terminal of the sixth switching element M6 is coupled to the first node N1, a second terminal of the sixth switching element M6 is coupled to third node N3, and a control terminal of the sixth switching element M6 receives a reset signal Sn−1. A first terminal of the seventh switching element M7 receives an initialization voltage Vin, a second terminal of the seventh switching element M7 is coupled to the first node N1, and a control terminal of the seventh switching element M7 receives the reset signal Sn−1. In the exemplary embodiment, the initialization voltage Vin is a low-level voltage, for example. On the one hand, the storage capacitor Cst can be reset by the initialization voltage Vin through the sixth switching element M6 and the seventh switching element M7 which responds to the reset signal Sn−1 to eliminate the influence of the residual voltage signal in the previous frame. On the other hand, when the enabling stage of the first scan signal Sn partially overlaps with the enabling stage of the reset signal Sn−1, the first switching element M1 is turned on in response to the first scan signal Sn, the seventh switching element M7 is turned on in response to the reset signal Sn−1, and then the data line connected with the first terminal of the first switching element M1 can be reset using the initialization voltage Vin. Thus, the residual data signal DATA on the data line in the previous frame can be removed, and the problem that low-level data signals DATA cannot be written is solved.

As compared with conventional technologies, complexity in timing sequences of the driving signals is not increased in the technical solutions provided by exemplary embodiments of the present disclosure. Also, because the initialization voltage Vin can be fairly low, the technical solutions in exemplary embodiments of the present disclosure can pull the voltage of the data line down to a level even lower than the voltage of the lowest-level data signal DATA which can be provided by the source driver. In addition, the first node N1 is coupled to the sixth switching element M6 which receives the driving voltage Vdd. Due to the effect of current leakage, even a small driving voltage Vdd can influence the voltage at the first node N1. Meanwhile, the first node N1 is coupled with the seventh switching element M7 which receives the initialization voltage Vin. Due to the effect of current leakage, even a small initialization voltage Vin can influence the voltage at the first node N1. However, the driving voltage Vdd and the initialization voltage Vin are usually opposite, the two effects of current leakages cancel each other out, and this is helpful for stabilizing the signals in the pixel driving circuit.

In an exemplary embodiment of the present disclosure, the reset signal Sn−1 is a second scan signal Sn−1 which can be provided by a second scan line. The second scan line is a scan line preceding to the first scan line. For example, the first scan line can be an N-th scan line, and the reset signal Sn−1 can be provided by the (N−1)-th scan line. In this way, the numbers of the control signals and the control lines can be reduced.

Figure 4:
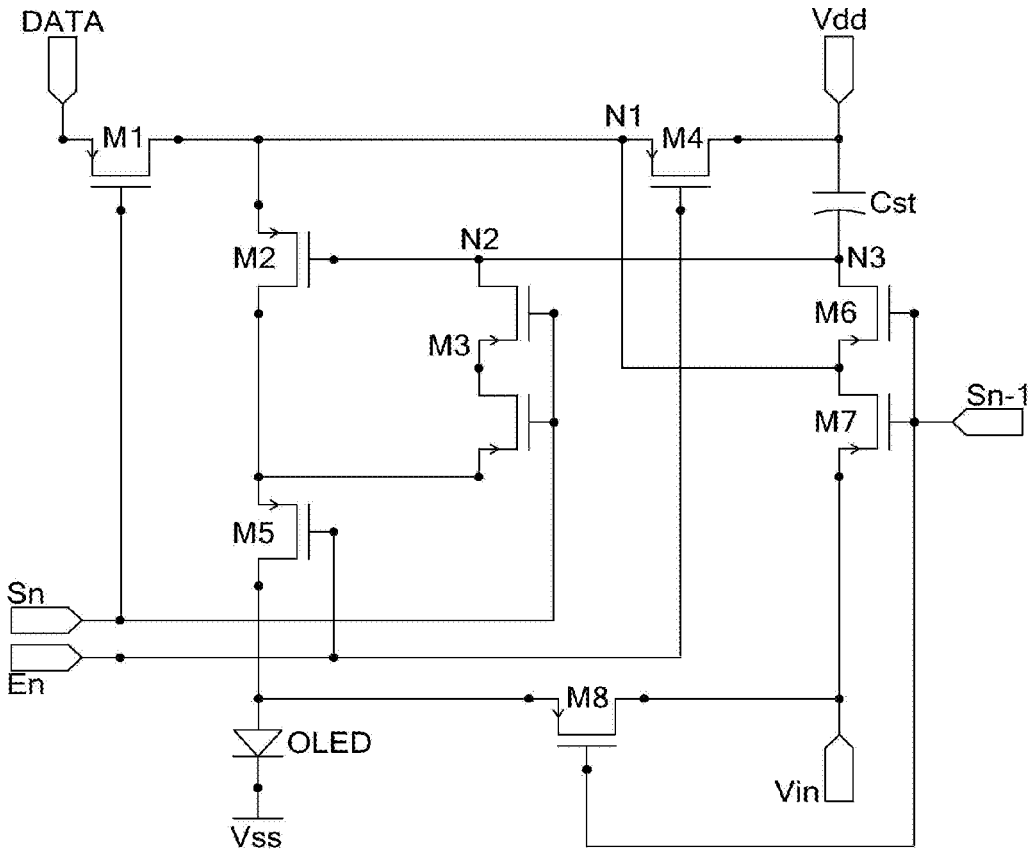
FIG. 4 is a schematic diagram showing a pixel driving circuit according to another exemplary embodiment.

In the exemplary embodiment, the pixel driving circuit can further include an eighth switching element. The eighth switching element receives the initialization voltage, is controllable by the reset signal and is coupled to the fifth switching element. For example, as shown in FIG. 4, the pixel driving circuit can further include an eighth switching element M8. A first terminal of the eighth switching element M8 is coupled to the second terminal of the fifth switching element M5, a second terminal of the eighth switching element M8 receives the initialization voltage Vin, and a control terminal of the eighth switching element M8 receives the reset signal Sn−1. In this way, the eighth switching element M8 can be turned on in response to the reset signal Sn−1, and the OLED can be reset by the initialization voltage Vin through the eighth switching element M8.

Referring to FIGS. 3 and 4 again, in the above exemplary embodiments, each of the switching element can include a transistor, and some of the switching elements can include two transistors connected in parallel (or double-gate transistor). For example, each of the first, second and fourth to eighth switching elements can be a single transistor, and the third switching element M3 can include two transistors connected in parallel.

According to another exemplary embodiment, the pixel driving circuit can employ transistors of a single channel type, i.e., all the transistors can be P type thin film transistors. Using transistors all of which are P type thin film transistors can have the following advantages. For example, the pixel driving circuit has strong noise suppression capability. For example, the P type thin film transistors can be turned on in response to a low level, and the low level is relatively easy to realize from the point of charge management. As another example, N type thin film transistors are prone to influence of ground bounce while P type thin film transistors are prone to influence of IR drop of the driving voltage Vdd, and the influence of the IR drop is generally easier to remove. As another example, the process for manufacturing the P type thin film transistors is relatively easier and less expensive. As another example, the P type thin film transistors have better stability. In view of the above, by using transistors all of which are P type thin film transistors, the complexity and costs of the manufacturing process can be reduced, and the product quality can be improved. As shown in FIGS. 3 and 4, when all the transistors are P type thin film transistors, the first terminal of the fourth switching element M4 and the storage capacitor Cst receive a high-level driving voltage Vdd, the second terminal of the fifth switching element M5 is connected to an anode of the OLED, and a cathode of the OLED receives a low-level voltage Vss.

Rather, one of ordinary skill in this art can conceive that the pixel driving circuit provided by the present disclosure can be modified as a pixel driving circuit in which all transistors are N type thin film transistors. The difference between the pixel driving circuit and the pixel driving circuit in which all transistors are P type thin film transistors resides in: when all the transistors are N type thin film transistors, the first terminal of the fourth switching element and the storage capacitor receive a low-level driving voltage, the second terminal of the fifth switching element is connected to the cathode of the OLED, and the anode of the OLED receives a high-level voltage. Rather, the pixel driving circuit provided by the present disclosure can be modified as CMOS (Complementary Metal Oxide Semiconductor) circuits and the like without being limited to the pixel driving circuit provided by embodiments of the present disclosure, and repeated descriptions are omitted here.

Figure 5:
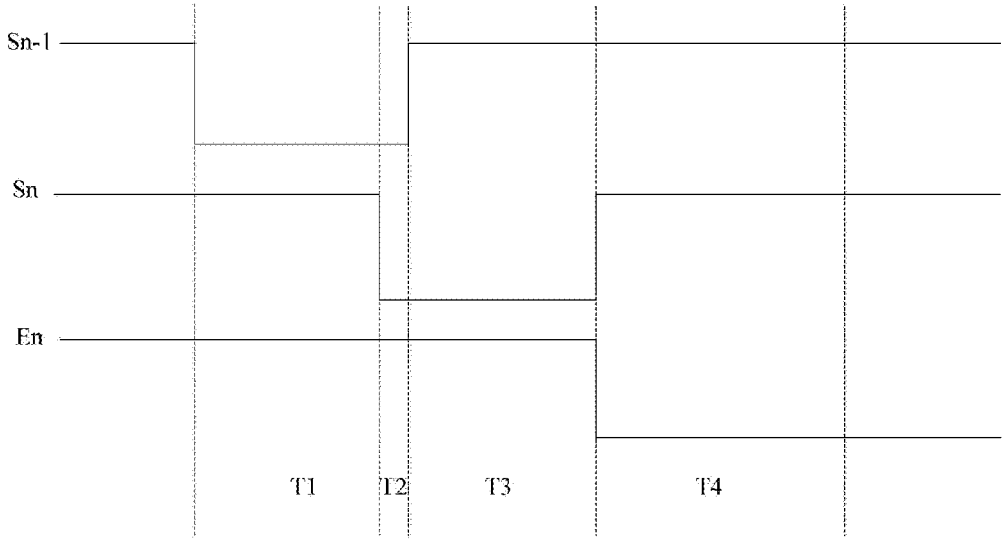
FIG. 5 is a diagram showing a driving sequence of the pixel driving circuit in FIG. 4.

The driving method of the pixel driving circuit in FIG. 4 will be described with reference to the driving timing as shown in FIG. 5. As shown in FIG. 5, the driving method mainly includes a first reset stage T1, a second reset stage T2, a charging stage T3, and a display stage T4.

Figure 6:
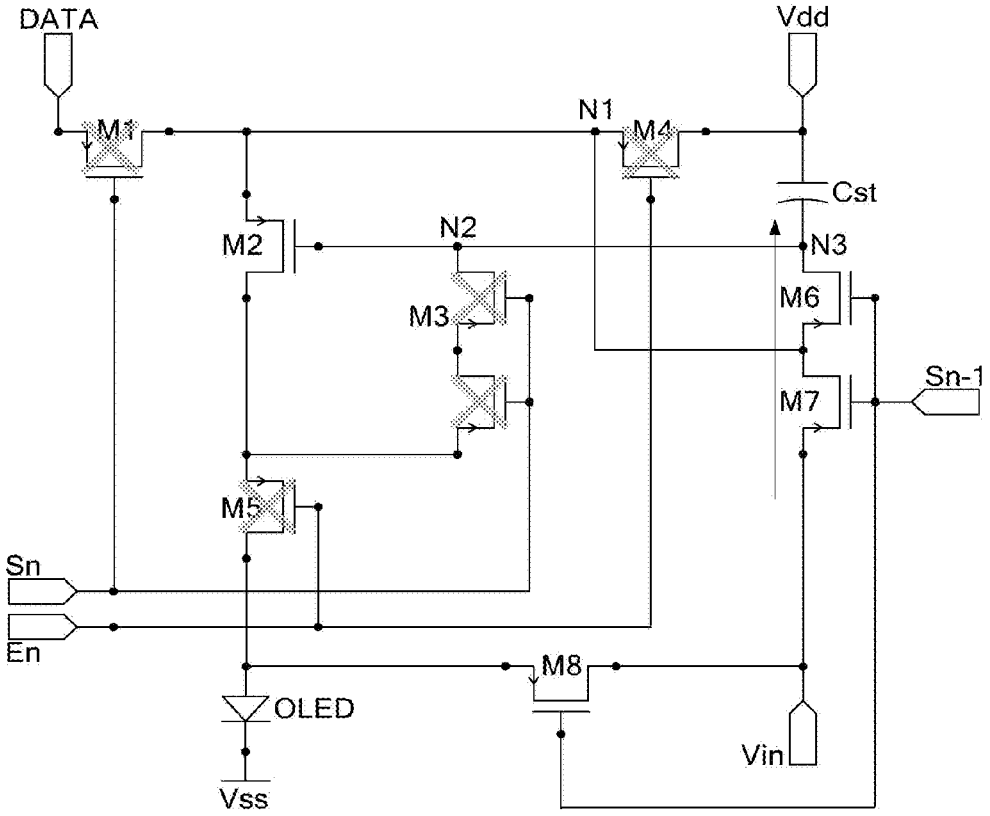
FIG. 6 is a diagram showing an equivalent circuit of the pixel driving circuit in FIG. 5 in a first reset stage.

As shown in FIGS. 5 and 6, in the first reset stage T1, both the first scan signal Sn and the light emitting signal En are at a high level, the first switching element M1, the third switching element M3, the fourth switching element M4 and the fifth switching element M5 are in an off state; the reset signal Sn−1 is at a low level, the sixth switching element M6, the seventh switching element M7 and the eighth switching element M8 are in an on state. After the sixth switching element M6 and the seventh switching element M7 are turned on, the initialization voltage Vin is applied onto the storage capacitor Cst through the sixth switching element M6 and the seventh switching element M7 so as to reset the voltage signal across the storage capacitor Cst. Thus, the influence of the residual voltage signal in the previous frame can be eliminated. After the eighth switching element M8 is turned on, the initialization voltage Vin is applied onto the OLED through the eighth switching element M8 so as to pull down the voltage applied on the OLED. Thus, the OLED can be reset.

Figure 7:
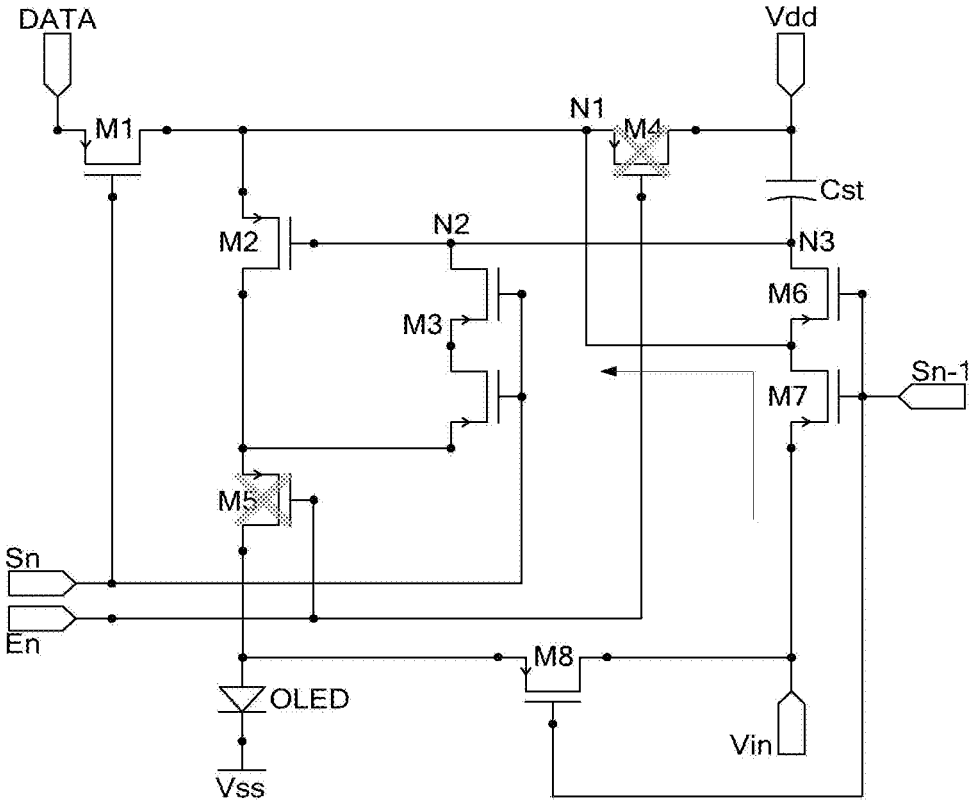
FIG. 7 is a diagram showing an equivalent circuit of the pixel driving circuit in FIG. 5 in a second reset stage.

As shown in FIGS. 5 and 7, in the second reset stage T2, the light emitting signal En is at a high level, the fourth switching element M4 and the fifth switching element M5 keep in the off state; the first scan signal Sn and the reset signal Sn−1 are at a low level, and the first switching element M1 and the seventh switching element M7 are in an on state. After the first switching element M1 and the seventh switching element M7 are turned on, the initialization voltage Vin is applied onto the data line connected to the first terminal of the first switching element M1 through the seventh switching eminent M7 and the first switching element M1 so as to eliminate the residual data signal DATA on the data line in the previous frame. Thus, the problem that low-level data signal DATA cannot be written is solved.

Figure 8:
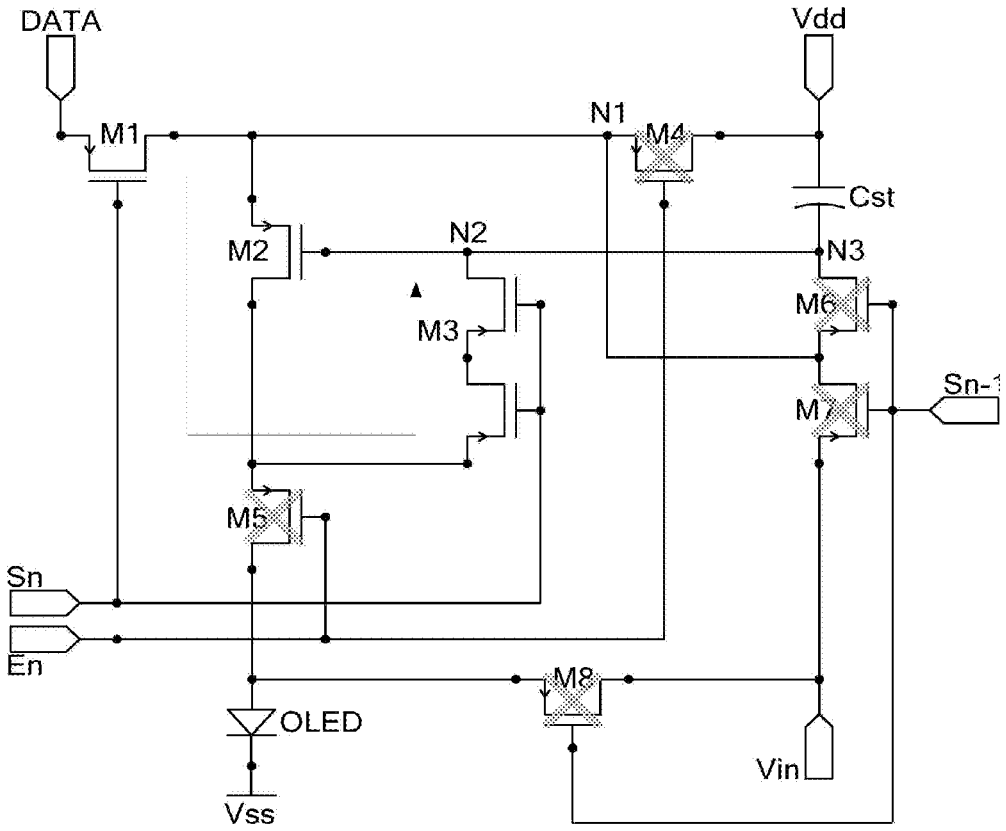
FIG. 8 is a diagram showing an equivalent circuit of the pixel driving circuit in FIG. 5 in charging stage.

As shown in FIGS. 5 and 8, in the charging stage T3, the reset signal Sn−1 and the light emitting signal En are at a high level, the fourth switching element M4, the fifth switching element M5, the sixth switching element M6, the seventh switching element M7 and the eighth switching element M8 are in an off state; the first scan signal Sn is at a low level, and the first switching element M1 and the third switching element M3 are in an on state. After the third switching element M3 is turned on, the second switching element M2 can form a diode connection, and the data signal DATA is written into the storage capacitor Cst through the first switching element M1, the second switching element M2 and the third switching element M3. In addition, a threshold voltage of the third switching element M3 is written into the storage capacitor Cst, so that the threshold voltage shift of the second switching element M2 can be compensated in subsequent display stage.

Figure 9:
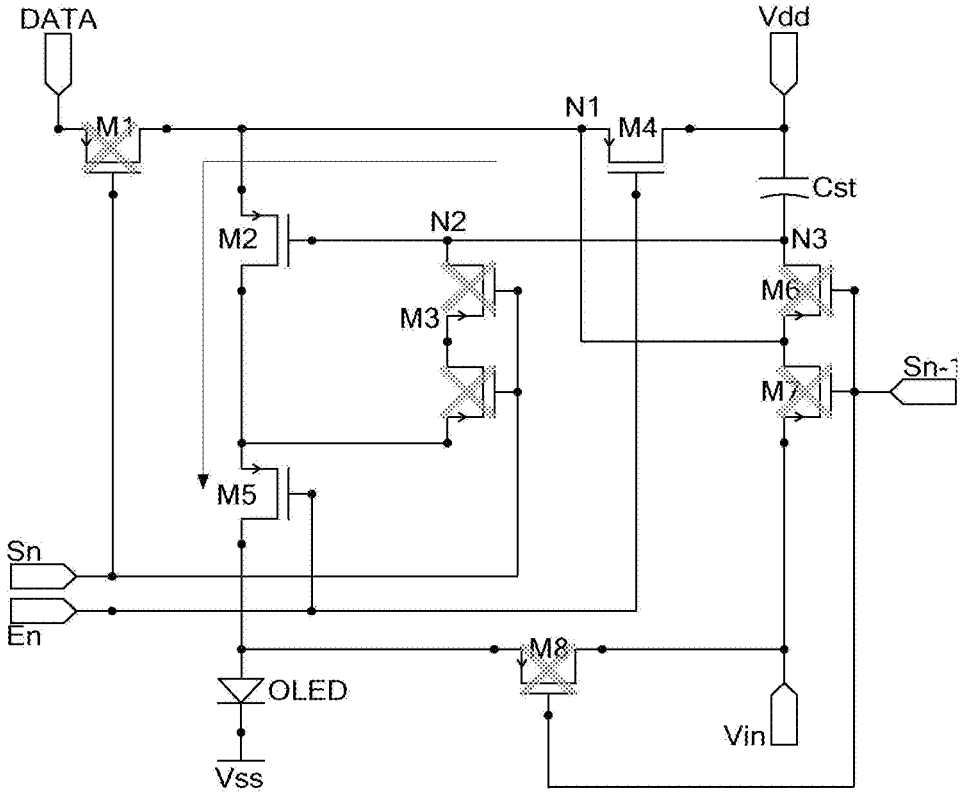
FIG. 9 is a diagram showing an equivalent circuit of the pixel driving circuit in FIG. 5 in a display stage.

As shown in FIGS. 5 and 9, in the display stage T4, the first scan signal Sn and the reset signal Sn−1 are at a high level, the first switching element M1, the third switching element M3, the sixth switching element M6, the seventh switching element M7 and the eighth switching element M8 are in an off state; the light emitting signal En is at a low level, and the fourth switching element M4 and the fifth switching element M5 are turned on. At the same time, under the driving of the voltage stored in the storage capacitor Cst, the second switching element M2 is turned on. After the second switching element M2, the fourth switching element M4 and the fifth switching element M5 are turned on, the driving voltage Vdd drives the OLED through the fourth switching element M4, the second switching element M2 and the fifth switching element M5 to enable the OLED to emit light.

Figure 10:
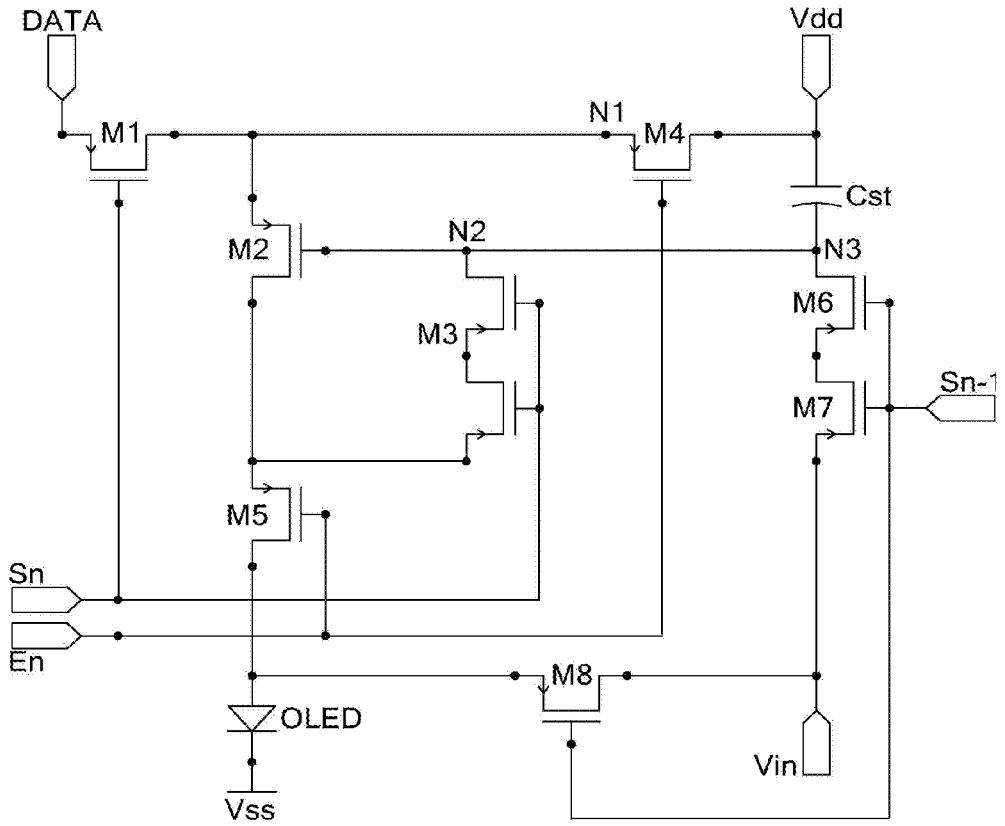
FIG. 10 is a schematic diagram showing a pixel driving circuit according to a control example.
Figure 11:
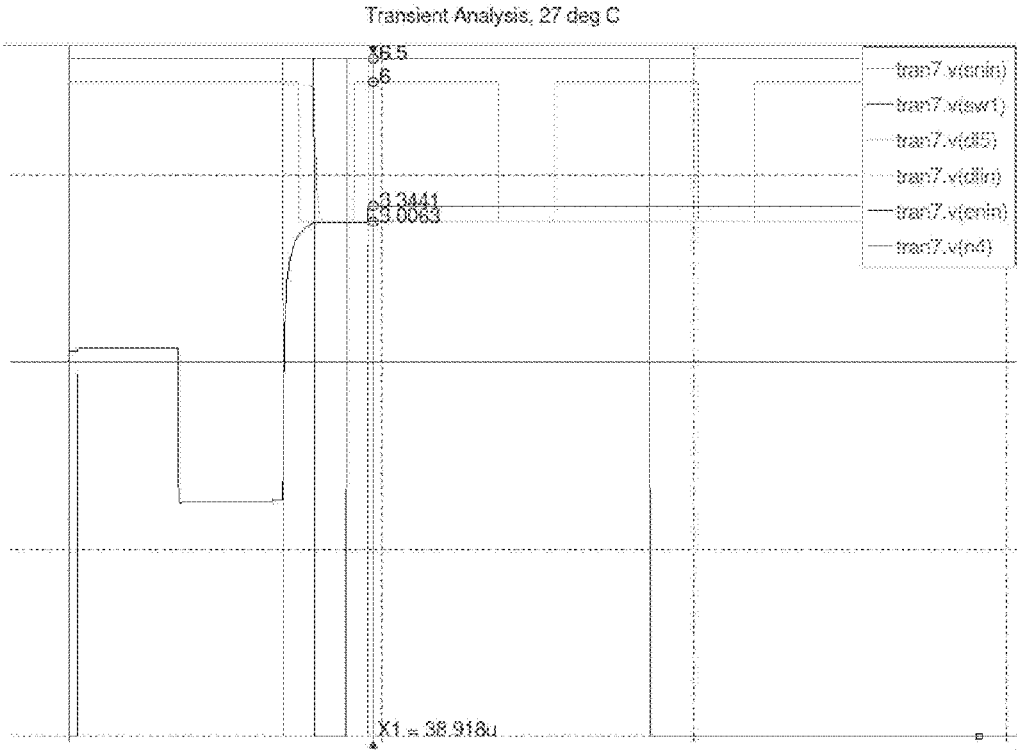
FIG. 11 shows signal waveforms of the pixel driving circuit in FIG. 10.
Figure 12:
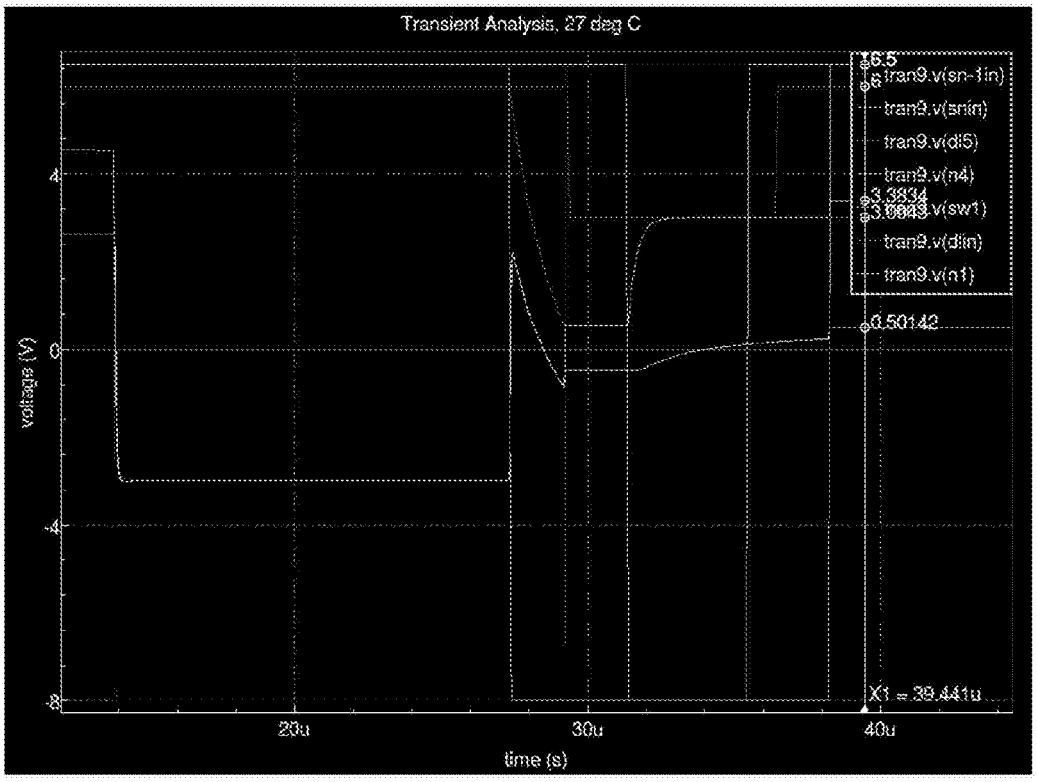
FIG. 12 shows signal waveforms of the pixel driving circuit in FIG. 4.

Further, inventors of the present disclosure have conducted simulations on the technical effects of the pixel driving circuit provided by exemplary embodiments of the present disclosure. FIG. 10 shows a pixel driving circuit according to a control example. The pixel driving circuit according to the control example cannot reset the data line by the driving circuit itself. FIG. 11 shows waveforms of signals in the pixel driving circuit according to the control example. As can be seen from FIG. 11, the 6V data signal in the previous frame is maintained on the data line, after the first switching element M1 is turned on by the first scan line Sn, the residual 6V data signal charge the first node N1 to make the voltage at the first node N1 rise to 3V. After the data line is turned on by the driving signal SW1, the OV data signal in the current frame cannot be written into the pixel driving circuit, and the voltage at the first node N1 is kept at 3V, and thus the image is shown abnormally. FIG. 12 shows waveforms of signals in the pixel driving circuit according to an exemplary embodiment of the present disclosure. As can be seen from FIG. 12, the residual data signal on the data line in the previous frame is reset in the exemplary embodiment, and thus the low-level data signal can be successfully written into the pixel driving circuit in the current frame. Consequently, the display device provided by the present disclosure can provide better display quality.

An exemplary embodiment of the present disclosure further provides a display device. The display device mainly includes a plurality rows of scan lines, a plurality columns of data lines and a plurality of pixel driving circuit. The plurality rows of scan lines output scan signals which include second scan signals and first scan signals provided alternately. The plurality columns of data lines output data signals. The plurality of pixel driving circuits are electrically coupled to the scan lines and data lines. In addition, the display device in the exemplary embodiment can further include a gate driver and a source driver. The gate driver provides the scan signals to the scan lines. The source driver includes M signal output portions, each of the signal output portions outputs the data signals to N columns of data lines. Each of the data lines is provided with a switch, M×N equals to the number of the data lines. For example, if there are 12 columns of data lines, N can be equal to 6, and M can be equal to 2. Because the pixel driving circuit in the display device can reset the data line to eliminate the residual data signal on the data line in the previous frame, the problem that low-level data signals cannot be written is solved. Thus, the display device can avoid the deficiencies in prior arts, and thereby provide improved display quality.

Exemplary embodiments of the present disclosure are shows and described above. However, it should be understood that the present disclosure is not limited to the above disclosed implementations. Instead, the present disclosure is intended to encompass various modifications and equivalent replacements within the scope of the appended claims.

What is claimed is:

1. A pixel driving circuit for driving an organic light emitting diode to emit light, wherein the pixel driving circuit comprises:
   - a first switching element configured to receive a data signal from a data line in response to a first scan signal, and coupled to a first node;
   - a second switching element coupled to the first node and a second node;
   - a third switching element configured to respond to the first scan signal and coupled to the second node and a third node;
   - a fourth switching element configured to receive a driving voltage in response to a light emitting signal, and coupled to the first node;
   - a fifth switching element configured to respond to the light emitting signal and coupled to the second node and the organic light emitting diode;
   - a sixth switching element configured to respond to a reset signal and coupled to the first node and the third node;
   - a seven switching element configured to receive an initializing voltage in response to the reset signal, and coupled to the first node; and
   - a storage capacitor coupled to the third node.

2. The pixel driving circuit according to claim 1, wherein an enabling stage of the first scan signal partially overlaps with an enabling stage of the reset signal.

3. The pixel driving circuit according to claim 2, wherein the reset signal is a second scan signal, the first scan signal is provided by an N-th scan line, and the second scan signal is provided by an (N−1)-th scan line.

4. The pixel driving circuit according to claim 1, wherein the pixel driving circuit further comprises:
   - an eight switching element configured to receive the initialization voltage in response to the reset signal, and coupled to the fifth switching element.

5. The pixel driving circuit according to claim 4, wherein each of the switching elements comprises a transistor.

6. The pixel driving circuit according to claim 5, wherein the third switching element comprises two transistors connected in parallel.

7. The pixel driving circuit according to claim 5, wherein all of the transistors are P type thin film transistors, the driving voltage is a high-level driving voltage, the fifth switching element is connected to an anode of the organic light emitting diode, and a cathode of the organic light emitting diode is connected to a low-level voltage.

8. The pixel driving circuit according to claim 5, wherein all of the transistors are N type thin film transistors, the driving voltage is a low-level driving voltage, the fifth switching element is connected to a cathode of the organic light emitting diode, and an anode of the organic light emitting diode is connected to a high-level voltage.

9. A driving method performed by a pixel driving circuit which is configured to drive an organic light emitting diode to emit light, wherein the method comprises:
   - in a first reset stage, turning on sixth and seventh switching elements in the pixel driving circuit by a reset signal, and resetting a storage capacitor in the pixel driving circuit by an initialization voltage through the sixth and seventh switching elements;

in a second reset stage, turning on a first switching element in the pixel driving circuit by a first scan signal and turning on the seventh switching element by the reset signal, and resetting a data line by the initialization voltage through the first and seventh switching elements;

in a charging stage, turning on the first switching element and a third switching element in the pixel driving circuit by the first scan signal to enable a second switching element in the pixel driving circuit to form a diode connection, and writing a data signal into the storage capacitor by the first, second and third switching elements;

in a display stage, turning on fourth and fifth switching elements in the pixel driving circuit using a light emitting signal and turning on the second switching element using the voltage stored in the storage capacitor, and driving the organic light emitting diode to emit light by the driving voltage through the fourth, second and fifth switching elements.

10. The driving method according to claim 9, further comprising:

in the first reset stage, turning on an eighth switching element in the pixel driving circuit by the reset signal, and resetting the organic light emitting diode by the initialization voltage through the eighth switching element.

11. A display device, comprising:

a plurality rows of scan lines configured to output scan signals comprising second scan signals and first scan signals which are provided alternately;

a plurality columns of data lines configured to output data signals; and a plurality of pixel driving circuits electrically connected to the scan lines and the data lines, wherein each of the pixel driving circuits comprises:

a first switching element configured to receive a data signal from a data line in response to a first scan signal, and coupled to a first node;

a second switching element coupled to the first node and a second node;

a third switching element configured to respond to the first scan signal and coupled to the second node and a third node;

a fourth switching element configured to receive a driving voltage in response to a light emitting signal, and coupled to the first node;

a fifth switching element configured to respond to the light emitting signal and coupled to the second node and the organic light emitting diode;

a sixth switching element configured to respond to a reset signal and coupled to the first node and the third node;

a seven switching element configured to receive an initializing voltage in response to the reset signal, and coupled to the first node; and a storage capacitor coupled to the third node.

12. The display device according to claim 11, further comprising:

a gate driver configured to provide scan signals to the scan lines; and a source driver comprising M signal output portions wherein each of the signal output portions outputs the data signals to N columns of data lines, each of the data lines is provided with a switch, and M×N equals to the number of the data lines.

13. The display device according to claim 12, wherein N equals to 6.

* * * * *